US007481911B2

(12) United States Patent
Hodgson et al.

(10) Patent No.: US 7,481,911 B2
(45) Date of Patent: Jan. 27, 2009

(54) FLUORINE CELL

(75) Inventors: Graham Hodgson, Lancashire (GB); Robert Dawson, Lancashire (GB)

(73) Assignee: The BOC Group PLC, Surrey (GB)

( * ) Notice: Subject to any disclaimer, the term of this patent is extended or adjusted under 35 U.S.C. 154(b) by 381 days.

(21) Appl. No.: 10/520,501

(22) PCT Filed: Jun. 27, 2003

(86) PCT No.: PCT/GB03/02758

§ 371 (c)(1),
(2), (4) Date: Jun. 15, 2005

(87) PCT Pub. No.: WO2004/005584

PCT Pub. Date: Jan. 15, 2004

(65) Prior Publication Data

US 2006/0113186 A1 Jun. 1, 2006

(30) Foreign Application Priority Data

Jul. 6, 2002 (GB) ..... 0215697.4

(51) Int. Cl.
*C25B 9/02* (2006.01)
*C25B 9/00* (2006.01)
*C25B 1/24* (2006.01)

(52) U.S. Cl. ..... 204/247; 204/286.1; 204/288.1

(58) Field of Classification Search ..... 204/247, 204/244, 286.1, 288, 288.1
See application file for complete search history.

(56) References Cited

U.S. PATENT DOCUMENTS

| | | | | |
|---|---|---|---|---|
| 2,739,115 | A | 3/1956 | Gall et al. | |
| 3,773,644 | A | 11/1973 | Tricoli et al. | |
| 4,354,916 | A * | 10/1982 | Pohto | 204/253 |
| 4,544,078 | A * | 10/1985 | Arenas et al. | 429/163 |
| 5,203,397 | A * | 4/1993 | Bandyopadhyay | 164/309 |
| 5,688,384 | A * | 11/1997 | Hodgson et al. | 204/228.2 |
| 6,210,549 | B1 * | 4/2001 | Tharp | 204/247 |

FOREIGN PATENT DOCUMENTS

| | | |
|---|---|---|
| JP | 2002161387 | 6/2002 |
| WO | WO-99/28538 | 6/1999 |

OTHER PUBLICATIONS

Japanese machine translation; Anode Attachment Part of Fluorine Electrolysis Tank, Fluorine Electrolysis Tank, and Method for Manufacturing Fluorine Gas JP 2002-161387A, Jun. 4, 2002.*
English Abstract for JP2002161387 (1 page).

* cited by examiner

*Primary Examiner*—Susy N Tsang-Foster
*Assistant Examiner*—William T Leader
(74) *Attorney, Agent, or Firm*—Rader, Fishman & Grauer PLLC

(57) ABSTRACT

An arrangement for installing and sealing an anode within a fluorine generating electrolytic cell is described, the arrangement comprising: an anode connection member, said anode connection member (32) passing through an aperture (70) in a skirt wall (20) and being in electrical connection with a skirt wall closure member (72) wherein the skirt wall closure member is sealingly engaged with said skirt wall and is electrically insulated therefrom.

20 Claims, 3 Drawing Sheets

FLUORINE CELL

FIELD OF INVENTION

The present invention relates to the construction of fluorine cells and particularly to the construction relating to the closing of the anode connection to the fluorine producing compartment in such a cell.

BACKGROUND OF THE INVENTION

Fluorine generating cells produce both gaseous fluorine and hydrogen by the electrolysis of hydrogen fluoride. Fluorine and hydrogen explosively recombine when they contact each other, therefore, it is necessary to keep them completely separate when generated during electrolysis. Fluorine cells are generally constructed such that the two gases are collected in two separate compartments above the surface level of the electrolyte. The compartments are often separated by means of a so-called skirt, the skirt often being part of and depending from an upper, generally horizontal wall of the cell, and extending into the electrolyte and surrounding the anode. However, the skirt must remain electrically neutral with respect to the anode which it surrounds and to the cathode which is often formed by the inner wall of the cell container vessel. It is, therefore, necessary that the skirt is electrically insulated from the anode (and cathode) and for the anode connection (often referred to as the "stud") to pass through the skirt or be connected thereto whilst completely sealing the fluorine compartment against leakage of fluorine.

It has been the practice to have a stud for connection to the anode and which stud passes through an insulating member and seal, often made of plastics material such as a fluoroelastomer rubber, in the upper horizontal skirt wall portion. However, due to the high currents which are inherent in fluorine generation by electrolysis a considerable amount of heat is generated by resistance heating, this condition often being exacerbated by poor electrical connection between the stud and carbon anode which is generally used. The effect of this heating can be to cause a runaway chemical reaction between the plastics seal material and the fluorine with which it is in direct contact and which may result in a fluorine leak. In extreme cases even the stud metal may itself burn in the fluorine gas stream in the resulting leak causing a so-called "stud fire". This has been somewhat alleviated by the construction shown in WO 96/08589 where, instead of the anode connecting stud passing through an insulating seal in the skirt wall, the stud is formed by welding stud members on either side of the skirt wall, so that there is no through hole, and closing the fluorine compartment by an insulating gasket remote from the anode stud. However, even in this construction, whilst an improvement on earlier constructions, the sealing gasket is still directly contacted by the fluorine gas and is still susceptible to attack especially when there is an unexpected temperature rise for any reason.

In the case of the semiconductor industry, for example, it is essential that any process plant utilising toxic or hazardous gases such as fluorine, for example, possesses the most stringent levels of leak tightness since the majority of people working in such plants generally wear only normal non-protective clothing.

SUMMARY OF THE INVENTION

It is an object of the present invention to provide a fluorine cell construction where significant areas of polymeric sealing members exposed to direct contact with fluorine are eliminated or minimised.

It is a further object of the present invention to provide a fluorine cell construction having a very high degree of integrity against fluorine leaks.

According to a first aspect of the present invention, there is provided an arrangement for sealing an anode within a fluorine generating electrolytic cell, the arrangement comprising: an anode connection member, said anode connection member passing through an aperture in a skirt wall and being in electrical connection with a skirt wall closure member wherein the skirt wall closure member is sealingly engaged with said skirt wall to seal said aperture and is electrically insulated therefrom, the arrangement being characterised by a non-conductive spacer member being interposed between the closure member and the skirt wall.

In the present invention the skirt wall closure member is sealingly engaged with the skirt wall around the aperture and electrically insulated from the skirt wall by means of an electrically non-conductive spacer member such as, for example, a ceramic spacer member. The spacer member may surround the anode connection member. The spacer member is essentially non-porous in the sense that there is no significant interconnected porosity which allows the passage of unacceptable quantities of fluorine gas to diffuse therethrough.

Examples of ceramic materials which may be utilised include alumina, calcium fluoride and magnesium fluoride. The material of the spacer member must be resistant to the effects of fluorine gas containing hydrogen fluoride at concentrations of up to 10 volume %.

In one embodiment of the arrangement of the present invention, the ceramic spacer is of annular form with flat, sealing faces and surrounds both the aperture through which the anode connection member extends and the anode connection member itself.

It is further preferred that the ceramic spacer member is sandwiched between two gaskets, one on each radial face thereof. In a preferred embodiment of the arrangement of the present invention the gaskets are so-called spiral wound gaskets which are supplied by many different manufacturers. Spiral wound gaskets comprise a spiral winding of a strip of at least one material which may be of "V" shaped cross section and known as the winding element. Frequently, there is a second element of similar cross sectional shape known as a sealing element, the two strips being nestled together and wound together so as to form alternate elements when viewed in cross section. The winding element is generally a metal which can be any metal of sufficient ductility and in any suitable metallurgical condition, e.g. annealed or cold worked, for example, and compatible with fluorine such as stainless steel or nickel, for example. The sealing element strip may be of a non-metallic material such as PTFE, expanded graphite or asbestos, for example, or may be of another, softer metal such as copper, for example. The spiral wound portion of the gasket may have inner and/or outer keeper rings to prevent the spiral wound portion from unwinding or deforming.

Where spiral wound gaskets having metallic elements in their construction are employed, a non-conductive spacer member such as the ceramic spacer member, for example, is necessary to provide electrical insulation of the anode from the skirt wall to render the latter electrically neutral.

In the present invention where, for example, the sealing element strip may be PTFE for example, because of the geometry of the gasket only a very small area of PTFE is exposed to the fluorine gas. However, spiral wound gaskets of fluorine-resistant all metal construction may be employed.

Such spiral wound gaskets as are contemplated in the present invention are by their nature generally of annular shape and construction and their size may be chosen to suit the radial face dimensions of the insulating spacer member.

The anode connection member may be welded to the inner surface of the skirt wall closure member. However, for reasons of dimensional accuracy, it is preferred that the anode connection member is a machined member which is attached to the skirt wall closure member by mechanical fasteners so that it and the anode may be easily removed for repair or maintenance. Such a construction generally requires that through holes be made in the skirt wall closure member and fasteners such as screws for example pass through holes to locate in suitable receiving holes in the anode connection member. It is possible to provide the fastening means with washers which seal against egress or leakage of fluorine through the fastener location holes via co-operating screw threads for example. However, in the interests of safety it is preferred that the anode fastening means may themselves be sealed from the ambient atmosphere with an auxiliary closure member which is sealed to the skirt wall closure member by means of a further gasket which surrounds the anode connection member fastening means. Such a further gasket may also advantageously comprise a spiral wound gasket.

Whilst spiral wound gaskets have proved to be exceptionally effective in the sealing arrangement of the present invention other types of gasket made from sheet metal such as copper, copper-nickel alloys or steel, for example, may be used in the form of embossed bead gaskets where elongate beads surrounding portions to be sealed are embossed into a metal sheet and which beads are then compressed during assembly to provide a seal.

The anode connection member may be for connecting to a separate anode such as a carbon anode by any known means or may itself be integrally formed with an anode portion which is adapted to be at least partially immersed in an electrolyte in the cell.

According to a second aspect of the present invention, there is provided a method of sealingly installing an anode in a fluorine generating electrolytic cell, the method comprising the steps of: providing a skirt member for a fluorine generating electrolytic cell, the skirt member being of open-ended construction which, when in use, a lower extremity of said open end is immersed in an electrolyte and forms a closed volume; forming an aperture in said skirt member to permit an anode connection member to pass through; suspending said anode connection member from a skirt wall closure member and sealing said aperture with said skirt wall closure member by providing at least one sealing, non-electrically conductive spacer member therebetween.

As described hereinabove, the at least one sealing, non-electrically conductive member may comprise a ceramic spacer member which is electrically non-conductive. In the interests of safety further sealing may be effected by suitable gaskets such as spiral wound gaskets, for example, preferably on each radial face of said spacer member.

The skirt wall, skirt wall closure member and an auxiliary closure member, where fitted, may be held together by conventional mechanical fastening means such as threaded studs, nuts and bolts and the like. The materials from which the constituent parts of the anode sealing arrangement may be made are those known and used in the fluorine generating art.

According to a third aspect of the present invention there is provided a fluorine generating cell having the anode sealing arrangement of the first aspect.

BRIEF DESCRIPTION OF THE DRAWINGS

In order that the present invention may be more fully understood, examples will now be described by way of illustration only with reference to the accompanying drawings, of which.

DETAILED DESCRIPTION OF THE INVENTION

Figure 1:
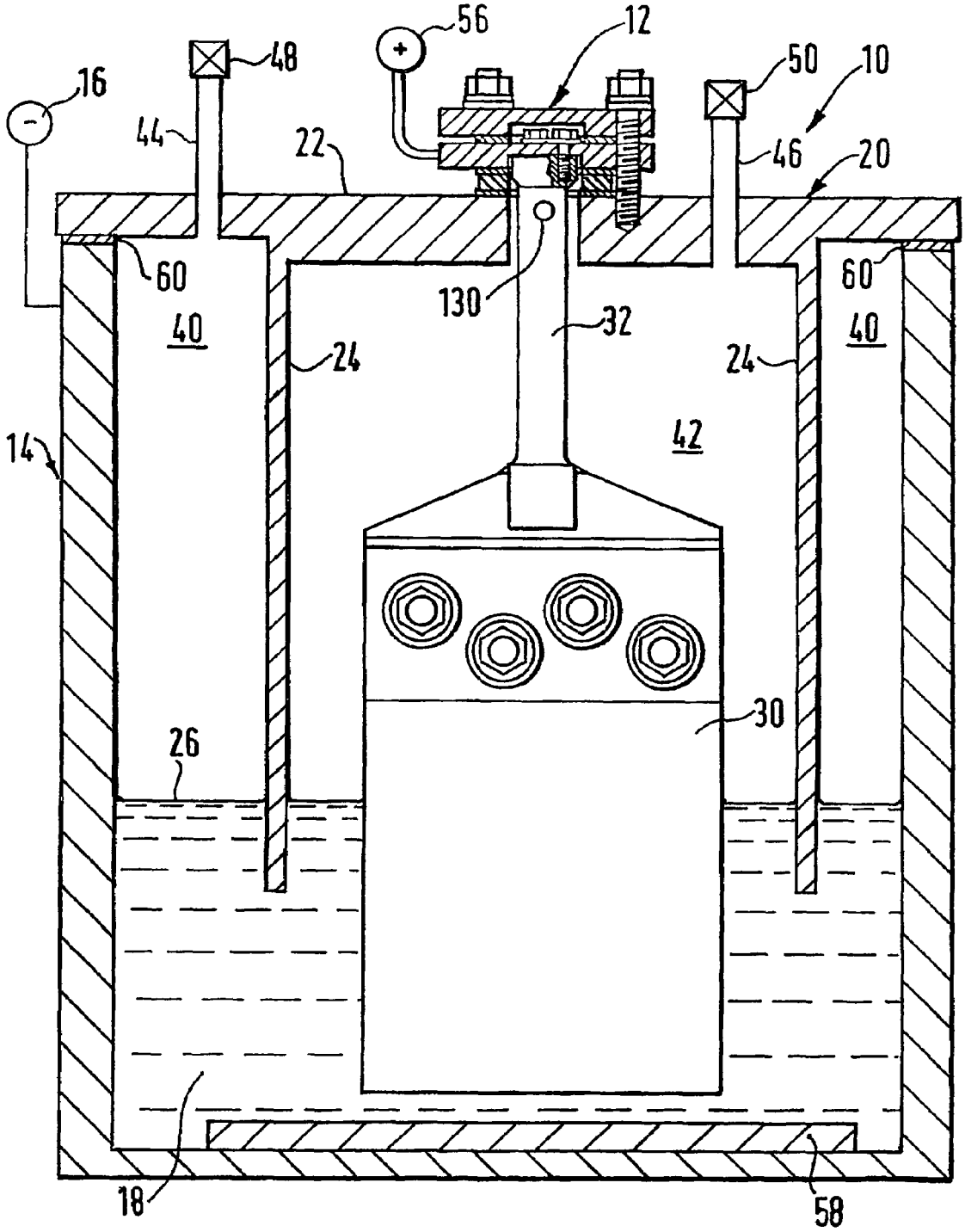
FIG. 1 shows an elevation in cross section of a schematic electrolytic fluorine generating cell having the arrangement of anode installation according to the present invention.

Referring now to the drawings and where the same features are denoted by common reference numerals.

FIG. 1 shows an elevation in part cross section of a schematic electrolytic fluorine generating cell 10 having an anode sealing arrangement 12 according to the present invention. Most of the cell is conventional and is only shown and described to place the anode sealing arrangement of the present invention in context.

The cell 10 includes an outer cell vessel 14 which also forms the cathode 16 and contains the electrolyte 18; a skirt member 20 which comprises a generally horizontal top plate 22 and a depending gas separating skirt member 24 which extends below the surface 26 of the electrolyte 18 and completely encircles an anode 30 and anode connection member 32; and, an anode sealing arrangement 12, in this case according to the present invention. The construction of the cell forms two separate compartments 40, 42, each closed at the lower end by the electrolyte surface 26, and which compartments receive hydrogen and fluorine, respectively upon electrolysis of the electrolyte 18 on passing a current therethrough. Outlet conduits 44 and 46 having valve means 48, 50 to control the flow of gas are provided for the two compartments. The anode sealing installation 12 according to the present invention also provides the anode connection 56. A heating jacket (not shown) is normally provided around the cell vessel 14 in order to melt the electrolyte which is normally solid at ambient temperature; the heating jacket may comprise a steam jacket or an electrically heated blanket for example. A plate 58, usually of a non-electrically conductive plastics material is fixed to the cell bottom to prevent hydrogen from being formed on the cathodic area below the anode compartment 42 and consequently rising into the fluorine compartment 42 and explosively recombining with the fluorine. The skirt 20 is electrically neutral being insulated from the cathodic vessel 14 by an insulating gasket 60 and from the anode sealing installation 12 by means which will be described in greater detail below. Insulating gasket 60 is not in contact with fluorine and skirt 20 is held to the top of the cell wall by mechanical fastening means (not shown), for example.

Figure 2:
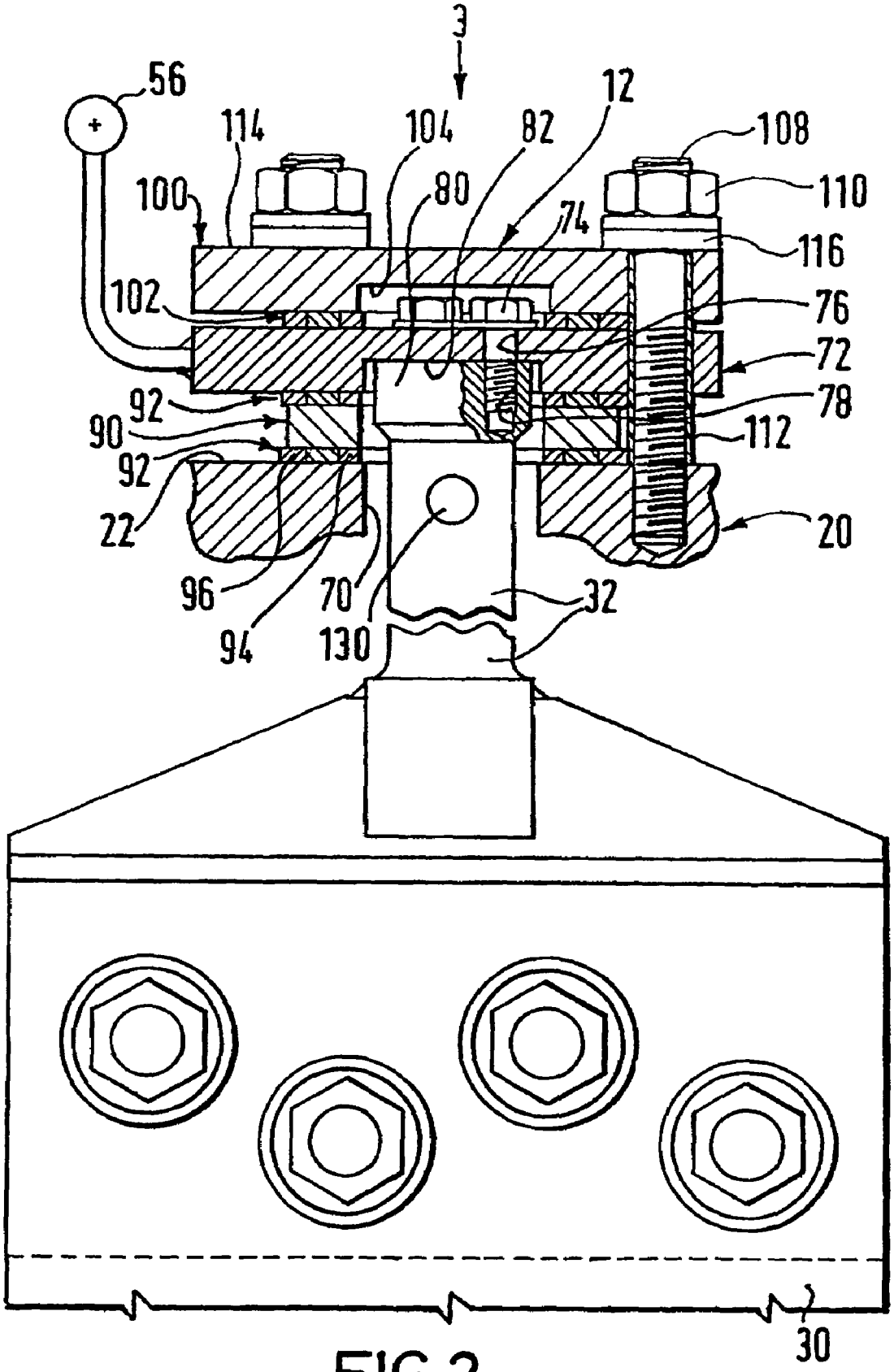
FIG. 2 shows the arrangement of anode sealing installation of FIG. 1 at a larger scale.
Figure 3:
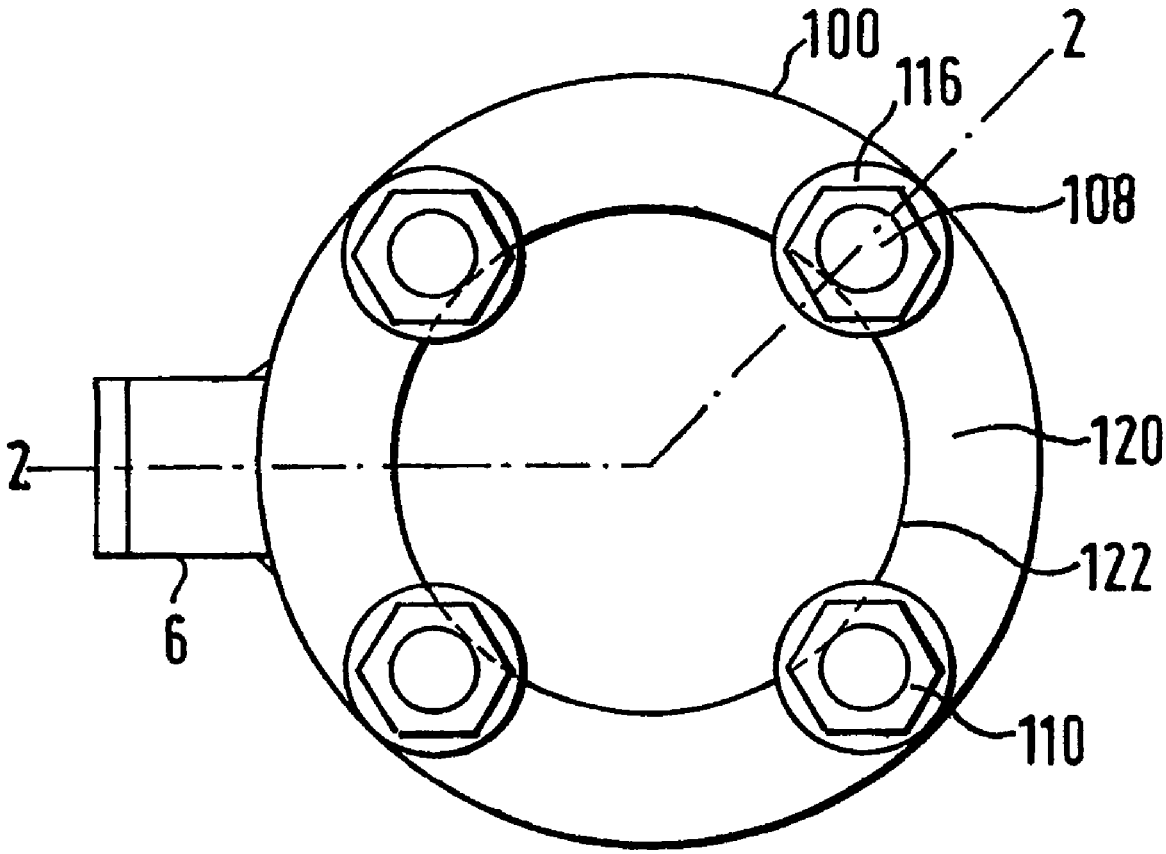
FIG. 3 which shows a plan view of the arrangement of FIGS. 1 and 2 in the direction of arrow 3 of FIG. 2

Referring now to FIGS. 2 and 3 where the anode sealing installation according to the present invention is shown in more detail. The sealing arrangement 12 of FIG. 2 is a section along the line 2-2 of FIG. 3. The anode connection member is ultimately connected to the anode 30 which is at least partially immersed in the electrolyte 18 as shown in FIG. 1, however, neither the anode nor its construction per se form any part of the invention and may be of any suitable construction or material according to the type of fluorine cell in which it is to be used. The anode connection member 32 (shown truncated in FIG. 2) passes through an aperture 70 in the horizontal top plate 22 of the skirt member 20. The anode connection member 32 is fixed to a skirt wall closure member 72 by means of screws 74 passing through holes 76 into threaded holes 78 in a boss 80 of the connection member 32, however, any means of connection of the member 32 to the closure member 72 may be employed. The arrangement described provides accuracy for the depending anode 30 in maintaining the anode 30 out of contact with the depending skirt wall member 24, but providing that accuracy can be assured, the connection member 30 may be welded, for example, to the underside 82 of the closure member 72. Alternatively, the end of the connection member 32 may be provided with a screw threaded male portion, for example, and screwed into a co-operating hole in the closure member 72, for example. The closure member 72 is insulated from the skirt 20 by a non-conductive annular spacer ring 90 which is positioned intermediate two annular gaskets 92. In this case the gaskets 92 are spiral wound gaskets having inner keeper rings 94 and outer keeper rings 96. Whilst the gaskets 92 are electrically conductive they are separated by the non-conductive spacer ring 90 which, in this case, is made of non-porous alumina ceramic. The spacer ring 90 and gaskets 92 provide complete sealing against leakage of fluorine and the spacer ring 90 provides electrical insulation of the anode 30 from the skirt 20. However, the existence of the holes 76 may provide a potential path for fluorine leakage and in the interests of complete safety an auxiliary closure member 100 is provided which is itself sealed to the closure member 72 by means of a further spiral wound gasket 102. A recess 104 is provided in the auxiliary closure member 100 to accommodate the heads of the screws 74. The auxiliary closure member 100, the closure member 72, the spacer ring 90, gaskets 92 and 102 are all held together by means of threaded studs 108 and nuts 110. The studs are insulated from the closure member 72 and auxiliary closure member 100 by insulating sleeves 112, in this case of Mylar (trade name) plastics material, extending along the length thereof and the nuts 110 are insulated from the auxiliary closure member top face 114 by insulating washers 116, in this case, of phenolic material such as Tufnol (trade name), for example. The spacer ring 90 and gaskets 92, 102 all lie within a pitch circle 120 defining the axes of the studs 108 and, of course, within a circle 122 defining the innermost extent of the stud 108 diameters thus, the insulating sleeves 112 and washers 116 are not subject to contact with fluorine. An electrical connector 56 is provided for a positive connection to the anode from a power source and controller (both not shown).

In the embodiment shown the auxiliary closure member 100 is used due the fact that there are through holes 76 in the closure member 72 for the screws 74 securing the anode connection member 32 thereto and which could possibly be a source of fluorine leakage. However, if a construction is employed where no through holes are provided in the closure member 72 for securing the connection member 32 thereto, the auxiliary closure member 100 would not be required. One important advantage of the construction shown with reference to the Figures is that accurate angular location of the anode 30 within the skirt wall portion 24 is automatically achieved.

In the embodiment described spiral wound gaskets have been used to seal the faces of the spacer ring 90 and the corresponding faces of the skirt top plate, closure member and auxiliary closure member. The construction of such gaskets is well known in the prior art and they are particularly suitable when used in the present invention. Where spiral wound gaskets constructed with a dual winding of metal and polymer elements such as described hereinabove are used, only a very small end face area at the end of the wound gasket is potentially exposed to fluorine gas. Where keeper rings are employed even this area is substantially eliminated. However, other types of metal gaskets may be used such as embossed bead gaskets where beads are embossed into an essentially flat metal plate and sealing is achieved by compression of the beads by the tightening loads.

The present invention effectively seals the fluorine compartment of the fluorine cell without the need to place large areas of polymer gasket materials in contact with fluorine and thus the risk of degradation causing fluorine leaks and the possibility of stud fires is greatly reduced compared with prior art sealing methods.

In the embodiment shown and described, the anode connection member 32 is further provided with a hole 130 to permit insertion of a retaining bar (not shown) therethrough for use when inspecting, servicing, replacing seals and the like or repairing the fluorine cell. When the anode sealing installation 12 is disassembled for servicing etc. the anode assembly may be lifted before removal of the closure member 72, the retaining bar inserted in the hole 130 and rested across the skirt top face 22 to prevent the anode 30 from dropping into the vessel bottom.

In another embodiment of the present invention, the anode connection member may be at least partially formed as an integral part of the closure member 72, e.g. as a spigot depending from the inner central part thereof and the anode joined thereto, for example, by an internally threaded collar co-operating with threaded ends on the anode connection portion at the upper end and a threaded end on a rod connected to an anode hanger at the lower end. Thus, in this embodiment the auxiliary closure member would not be required. Furthermore, the closure member and the anode connection member are a unitary item.

Fluorine cells constructed according to the present invention have been found to have very high integrity against fluorine leaks and have leak tightness sufficient to pass a helium leak test at better than $10^{-5}$ sccm (standard cubic centimetre min).

The types of seal members which may be employed in the present invention include but are not limited to: all metal seals such as ring joints made from steels, nickel, copper, copper-nickel alloys and aluminium; spiral wound joints using all metal windings; and, profile joints such as the bead type gaskets described hereinabove. Alternatively, part metal seals may be employed and may include but are not limited to: ring joints made from soft sealing materials where the sealing material is encapsulated in a groove or tongue and groove; spiral wound joints incorporating metal windings combined with soft sealing windings; and envelope joints comprising a metal envelope within which a filler material is encapsulated.

The invention claimed is:

1. A fluorine electrolytic cell comprising:

an anode connection member having an end portion;

a skirt wall structure having a top plate, said top plate having an aperture, said anode connection member passing through said aperture;

a skirt wall top plate closure member being in sealing engagement with said skirt wall top plate, said skirt wall top plate closure member being in electrical communication with said anode connection member to constitute an anode connection to said fluorine electrolytic cell; and a non-conductive spacer member being sealingly disposed between said skirt wall top plate closure member and an outer surface of said skirt wall top plate, wherein said end portion of said anode connection member is retained by said skirt wall top plate closure member, said end portion of said anode connection member being spaced apart from said skirt wall top plate and said aperture by said spacer member and said skirt wall top plate closure member.

2. The fluorine electrolytic cell of claim 1, wherein said spacer member is made from a ceramic including one of alumina, calcium fluoride, and magnesium fluoride.

3. The fluorine electrolytic cell of claim 1, wherein said spacer member is of a generally annular form around said anode connection member.

4. The fluorine electrolytic cell of claim 1, wherein said spacer member is disposed between gaskets that seal between an upper face of said skirt wall top plate and a lower face of said spacer and an upper face of said spacer and a lower face of said skirt wall top plate closure member.

5. The fluorine electrolytic cell of claim 4, wherein at least one of said gaskets is a spiral wound gasket.

6. The fluorine electrolytic cell of claim 5, wherein said spiral wound gasket includes at least one inner keeper ring.

7. The fluorine electrolytic cell of claim 5, wherein said spiral wound gasket includes at least one outer keeper ring.

8. The fluorine electrolytic cell of claim 4, wherein at least one of said gaskets is a metal bead gasket.

9. The fluorine electrolytic cell of claim 8, wherein said metal bead gasket includes a metal plate having a bead embossed therein.

10. The fluorine electrolytic cell of claim 1, wherein said end portion of said anode connection member is welded to said skirt wall top plate closure member.

11. The fluorine electrolytic cell of claim 1, wherein said end portion of said anode connection member is connected to said skirt wall top plate closure member by at least one mechanical fastener.

12. The fluorine electrolytic cell of claim 1, further comprising an auxiliary closure member.

13. The fluorine electrolytic cell of claim 12, wherein said auxiliary closure member is in sealing engagement with said skirt top plate wall closure member.

14. A method of installing an anode in a fluorine generating electrolytic cell comprising the steps of:

providing a skirt member structure for said fluorine generating electrolytic cell, said skirt member being of open-ended construction having a lower extremity that is immersed in an electrolyte forming a closed volume;

forming an aperture in a top plate of said skirt member structure to permit an anode connection member to pass through; and suspending said anode connection member from a skirt wall top plate closure member and sealing said aperture with said skirt wall top plate closure member by providing at least one non-electrically conductive spacer member therebetween, wherein an end portion of said anode connection member is retained by said skirt wall top plate closure member, wherein said end portion of said anode connection member is spaced apart from said skirt wall top plate and said aperture by said at least one spacer member and said skirt wall top plate closure member.

15. A fluorine electrolytic cell comprising:

an anode connection member;

a skirt wall structure having a top plate member, said top plate member having an aperture therethrough, said anode connection member in communication with said aperture;

a skirt wall top plate closure member being in sealing engagement with said skirt wall top plate, said skirt wall top plate closure member being in electrical communication with said anode connection member, wherein an end portion of said anode connection member is retained by said skirt wall top plate closure member;

a non-conductive spacer member having an upper surface and a lower surface, said spacer member being disposed between and in sealing engagement with said skirt wall top plate closure member and said skirt wall top plate, said skirt wall top plate closure member being electrically insulated from said skirt wall top plate, said end portion of said anode connection member being spaced apart from said skirt wall top plate and said aperture by said spacer member and said skirt wall top plate closure member;

at least one upper gasket disposed on said upper surface of said spacer member; and at least one lower gasket disposed on said lower surface of said spacer member.

16. The fluorine electrolytic cell of claim 15, wherein at least one of said gaskets is a spiral wound gasket.

17. The fluorine electrolytic cell of claim 16, wherein said spiral wound gasket includes at least one inner keeper ring.

18. The fluorine electrolytic cell of claim 16, wherein said spiral wound gasket includes at least one outer keeper ring.

19. The fluorine electrolytic cell of claim 15, wherein at least one of said gaskets is a metal bead gasket.

20. The fluorine electrolytic cell of claim 19, wherein said metal bead gasket includes a metal plate having a bead embossed therein.

* * * * *